United States Patent [19]

Yeamans

[11] Patent Number: 5,025,604

[45] Date of Patent: Jun. 25, 1991

[54] PERIMETER SECUREMENT ASSEMBLY FOR ROOF DECK COVERING PROVIDED WITH APERTURED OVERLAY

[76] Inventor: Robert C. Yeamans, 2777 Northwest Blvd., Columbus, Ohio 43221

[21] Appl. No.: 462,517

[22] Filed: Jan. 9, 1990

[51] Int. Cl.[5] ..... E04B 7/00; E04D 13/14; E04D 13/15

[52] U.S. Cl. ..... 52/273; 52/58; 52/94; 52/288

[58] Field of Search ..... 52/96, 23, 287, 288, 52/94, 97, 222, 273, 58

[56] References Cited

U.S. PATENT DOCUMENTS

| | | |
|---|---|---|
| 2,041,929 | 5/1936 | Hitzman . |
| 3,012,376 | 12/1961 | Reddy et al. . |
| 3,336,704 | 8/1967 | Clay . |
| 3,405,485 | 10/1968 | Edwards . |
| 3,410,038 | 11/1968 | Gobel . |
| 3,421,276 | 1/1969 | La Barge . |
| 3,531,899 | 10/1970 | Bartlett . |
| 3,774,364 | 11/1973 | Johnson . |
| 3,783,931 | 1/1974 | Assael . |
| 3,834,104 | 9/1974 | Dunn et al. . |
| 3,862,876 | 1/1975 | Graves . |
| 3,958,374 | 5/1976 | Gobel . |
| 4,018,260 | 4/1977 | Baslow . |
| 4,037,372 | 7/1977 | Patry . |
| 4,067,152 | 1/1978 | Wolma . |
| 4,241,549 | 12/1980 | Hall, III et al. . |
| 4,335,546 | 6/1982 | Kelly . |
| 4,403,458 | 9/1983 | Lolley . |
| 4,404,777 | 9/1983 | Lolley et al. . |
| 4,409,761 | 4/1981 | Bechtel . |
| 4,419,850 | 12/1983 | Butzen . |
| 4,519,172 | 5/1985 | Ristow ..... 52/96 |
| 4,534,145 | 8/1985 | Yang et al. . |
| 4,549,376 | 10/1985 | Hickman . |
| 4,592,176 | 6/1986 | van Herpen . |
| 4,598,507 | 7/1986 | Hickman . |
| 4,665,670 | 5/1987 | van den Burg . |
| 4,694,543 | 9/1987 | Conley . |
| 4,759,157 | 7/1988 | Webb et al. . |
| 4,817,655 | 4/1989 | Brooks . |

*Primary Examiner*—Michael Safavi
*Attorney, Agent, or Firm*—John L. Gray

[57] ABSTRACT

A perimeter securement assembly for a roof deck covered with a waterproofing membrane and an apertured overlay thereover comprises a coved base member adapted to be positioned along the periphery of the roof with the waterproofing membrane extending thereof and secured therein by means of a resilient member which hold the membrane in the coved portion. In one version the apertured overlay is provided with openings along its selvage edge, said openings engaging the one end of an S-shaped hook, the other end of said hook engaging the coved base member and being held in place by the resilient means. In another version a continuous flat hook-shaped member extends over the membrane and the coved base member, is held in place by resilient means, and is attached to the selvage edge of the apertured overlay by means of heat welding.

9 Claims, 2 Drawing Sheets

PERIMETER SECUREMENT ASSEMBLY FOR ROOF DECK COVERING PROVIDED WITH APERTURED OVERLAY

BACKGROUND OF THE INVENTION

At the present time, roof waterproofing membranes used in flat commercial and industrial roofing applications are secured around the periphery of the roof deck by means of mechanical fasteners through the waterproofing membrane, in combination with adhesives and flashing materials. Such applications result in disengagement, puncturing, tearing or otherwise damaging the waterproofing membrane and flashing when the waterproofing membrane billows as a result of wind-uplift forces, a condition associated with changes in atmospheric pressure. Expansion and contraction of the waterproofing membrane and flashing, due to temperature changes, can result in loosening of the waterproofing membrane and flashing from the periphery of the roof deck. The net result is that the roofing application ultimately fails.

Applicant's copending patent application, Ser. No. 294,023 entitled ROOF DECK COVERING SYSTEM, now U.S. Pat. No. 4,926,596, incorporated herein by reference, describes a new combination of a waterproofing membrane held in place by means of an apertured overlay.

Applicant's copending patent application Ser. No. 294,038 entitled PERIMETER SECUREMENT ASSEMBLY FOR ROOF DECK COVERING, now U.S. Pat. No. 4,912,900, incorporated herein by reference describes a peripheral securement system for either a membrane alone on a roof, or a membrane in combination with an apertured overlay.

SUMMARY OF THE INVENTION

The present invention involves the combination of a one-piece fabricated coved securement base with a resilient compression retainer with associated connector for positively securing the waterproofing membrane and the apertured overlay on the top of a roof.

A coved securement base may be metallic or nonmetallic, cast, molded, rolled, drawn, extruded, stamped, or formed. Preferably this is a single extrusion. The resilient compression retainer may be metallic or nonmetallic. Preferably it is a rubber extrusion having a durometer number of 40–70 Shore A which is utilized between the waterproofing membrane and the coved portion of the base member. In one version the compression retainer also holds individual S-shaped connectors in place which are hooked over the lower lip of the coved securement base and also hooked into slots provided in the selvage edge of the apertured overlay which is positioned on top of the waterproofing membrane thus holding the apertured overlay in position.

In another version the resilient compression retainer also holds a continuous nonmetallic connector which has a hook portion which hooks over the lower lip of the coved securement base and the other portion of the connector may be welded to the apertured overlay periodically by a heat weld.

It is therefore an object of this invention to provide a roof perimeter securement assembly which may be used to hold a roof waterproofing membrane and an apertured overlay securely on a roof deck.

It is also an object of this invention to provide a perimeter securement assembly for a roof deck covering for securing the roof waterproofing membrane and the apertured overlay in place without puncturing or damaging the membrane by means of mechanical fasteners.

These, together with other objects and advantages of the invention will become more readily apparent to those skilled in the art when the following general statements and descriptions are read in the light of the appended drawings.

DETAILED DESCRIPTION OF THE INVENTION

Figure 1:
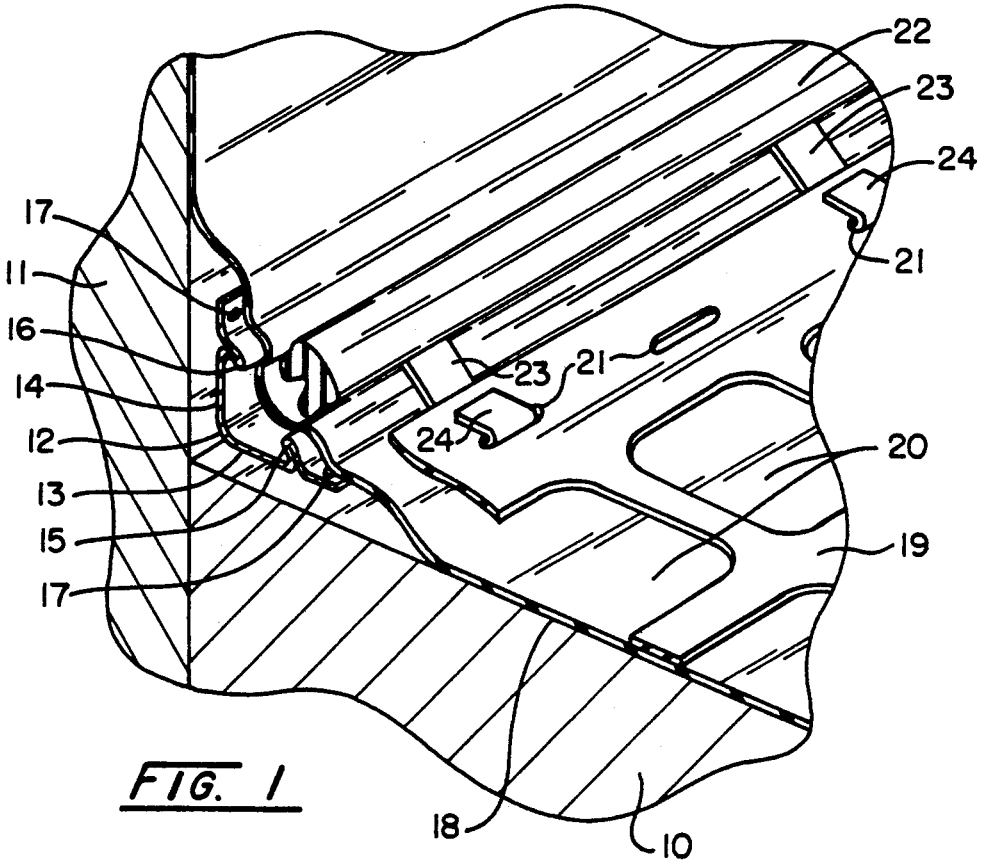
FIG. 1 is a perspective view of one version of applicant's invention with portions of the apertured overlay broken away.

Referring now more particularly to FIG. 1, the roof deck is shown at 10 adjacent to a parapet or wall 11. The base member 12 of the applicant's invention comprises two flat portions. Portion 13 is designed to be parallel to the roof surface and portion 14 extends at approximately right angles to portion 13 and completes the coved portion of member 12. Two members extend inwardly facing each other from portions 13 and 14. Member 15 extends inwardly from portion 13 and member 16 extends inwardly from portion 14. The base member 12 may be cast, molded, rolled, drawn, extruded, stamped, or formed and may be made from a metallic or a nonmetallic material. Preferably it is made from an extruded metallic material. The base member 12 may be attached to the parapet or wall 11 and the roof deck 10, or a nailing strip on the roof deck 10, by fasteners 17—17. As shown, the waterproofing membrane 18 lies on the roof deck 10, and is covered with an apertured overlay 19. In one version of applicant's invention this apertured overlay 19, in addition to the normal apertures 20—20 is provided with slots 21—21 in the selvage edge thereof. Resilient compression retainer 22 is provided which fits into the portion of the base member 12 between members 15 and 16 holding the membrane 18 in place. While an extruded rubber retainer 22 having a durometer number of 40–70 Shore A is preferred, other retainers that will function in the same fashion, including metallic spring retainers, may be utilized. Retainer 22 is designed so that it engages a substantial portion of the interior surfaces and edges of elements 15 and 16. Before the retainer 22 is inserted in the space between members 15 and 16, an individual S-shaped connector 23 is positioned with one end of the S 24 hooked into the slot 21 in the selvage edge of the apertured overlay 19. The other portion of the S surrounds member 15 and is held in place by means of the retainer 22.

Figure 2:
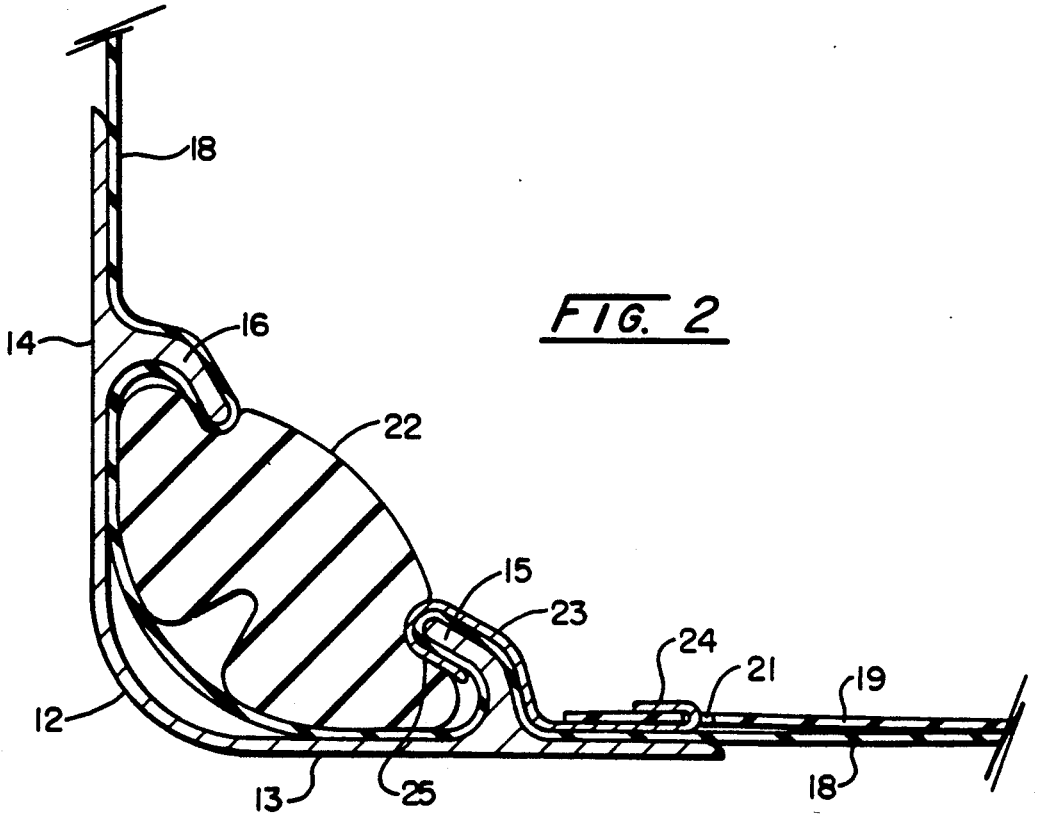
FIG. 2 is an end sectional view of applicant's invention shown in FIG. 1.

This is perhaps better understood by referring to FIG. 2 wherein the individual S-shaped connector 23 is shown with its S-shaped end 25 hooked over member 15 and membrane 18 firmly held in place by the resilient member 22, while the end 24 hooks into slot 21 in the selvage edge of the apertured overlay 19.

Figure 3:
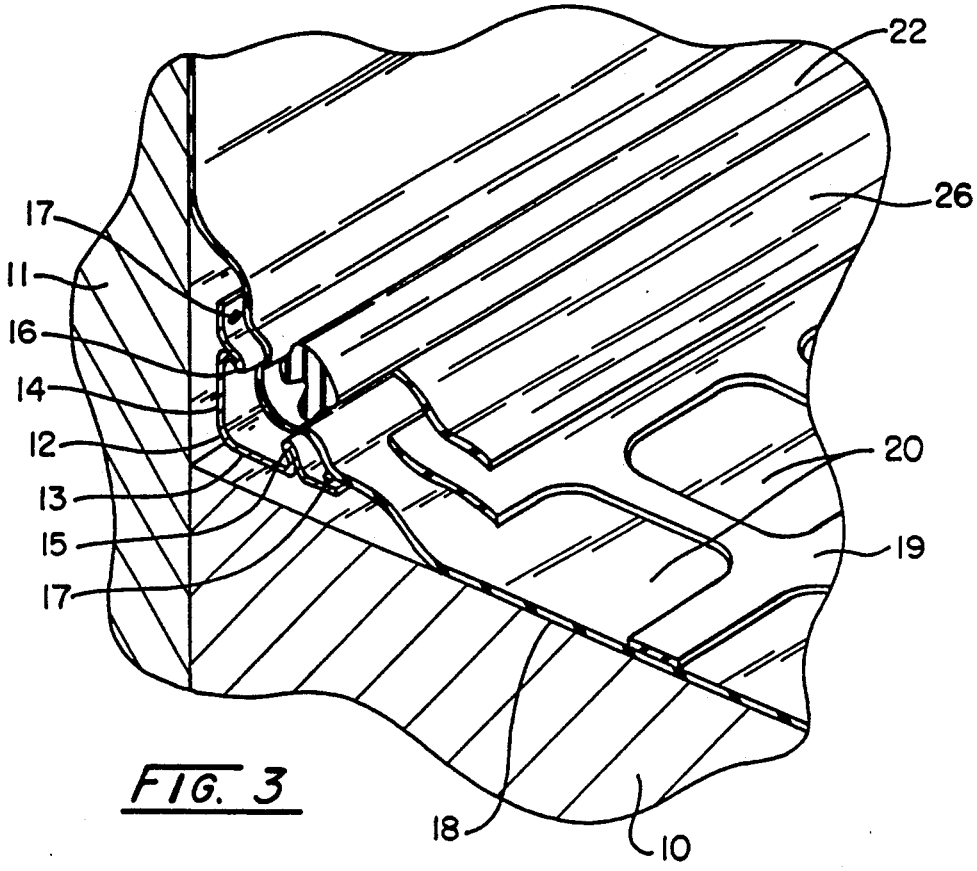
FIG. 3 is a perspective view of another version of applicant's invention with portions of the apertured overlay broken away.
Figure 4:
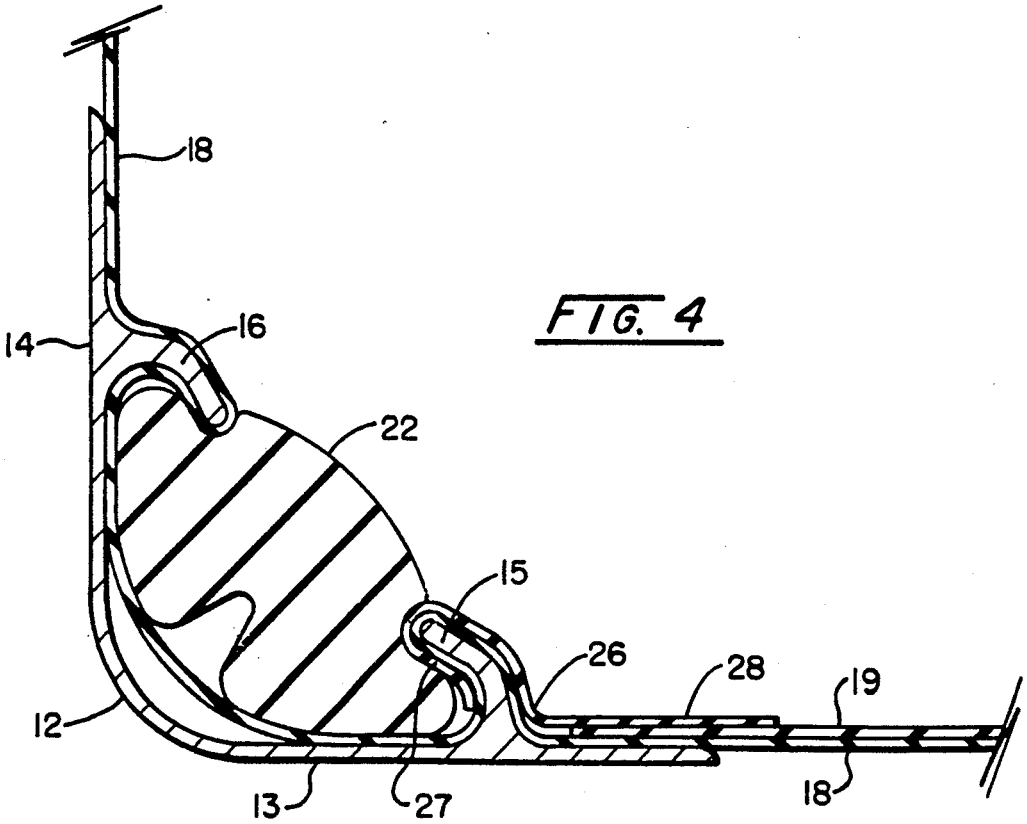
FIG. 4 is an end sectional view of applicant's invention shown in FIG. 3.

In another version of applicant's invention shown in FIGS. 3 and 4, the continuous nonmetallic connector 26 fits over member 15 of base member 12 and is held in place by retainer 22. This is perhaps better seen in FIG. 4 where the hooked portion 27 of member 26 is shown extending over and around member 15 and membrane 18 firmly held in place by retainer 22. The flat portion 28 of connector 26 may be heat-welded to the selvage edge of the apertured overlay 19 along its length at various points as desired. The connector 26 may be of any useful length; 8 to 12 feet would be a length that would be easy to handle in installation.

The base member 12 may be any suitable length. The length is only restricted by its ease of application and means of transportation. The waterproofing membrane 18 may be fastened to the parapet or wall 11 by suitable means well-known to the industry. If there is no parapet or wall 11, a fascia may be used which will extend over the upper portion of the base member 12 with the waterproofing membrane 18 being enclosed between fascia and base member 12 thereby terminating the waterproofing membrane. The apertured overlay 19 which covers the waterproofing membrane 18 to prevent billowing is described in detail in applicant's copending patent application Ser. No. 294,023, now U.S. Pat. No. 4,926,596, incorporated herein by reference.

The use of this perimeter securement assembly for roof deck covering shows a permanent securement of the waterproofing membrane and an apertured overlay without mechanically puncturing or adhesively securing the waterproofing membrane.

While this invention has been described in its preferred embodiment, it is to be appreciated that variations therefrom may be made without departing from the true scope and spirit of the invention.

What is claimed:

1. In a roof deck covering comprising a waterproofing membrane positioned on the surface of said roof deck and an apertured overlay having one or more selvage edges positioned atop said waterproofing membrane and essentially coextensive therewith, a perimeter securement assembly for a roof deck covering for securely fastening said waterproofing membrane and said apertured overlay to the periphery of said roof deck comprising, a base member capable of being firmly attached to said roof deck and designed to extend along and adjacent to the edge of said roof deck and including a first portion designed to be substantially parallel to the surface of said roof deck and a second portion connected to said first portion and extending essentially at right angles to said first portion and adjacent the edge thereof, said first portion of said base member being provided with a first element extending in a direction toward said second portion of said base member, and said second portion of said base member being provided with a second element extending in a direction toward said first portion of said base member, a connector provided with a first means attached securely to said first element and extending thereover and being provided with a second portion attached securely to said apertured overlay, and a first resilient means of a shape conforming to that portion of said base member between said first and second elements and adapted to press said waterproofing membrane securely against said base member between said first and second elements and to press said first means on said connector securely against said first element.

2. The perimeter securement assembly of claim 1 wherein said apertured overlay is provided with spaced openings in the selvage edge thereof and said second portion is adapted securely to engage the openings in the selvage edge of said apertured overlay.

3. The perimeter securement assembly of claim 1 wherein said second portion is adapted securely to be attached to said apertured overlay by welding.

4. The perimeter securement assembly of claim 1 wherein said connector is generally in the form of an S in cross section.

5. The perimeter securement assembly of claim 4 wherein said S-shaped connector is flattened with one portion of a size and shape adapted to overlay and engage said first element.

6. The perimeter securement assembly of claim 5 wherein said connector is provided with a flattened S-portion of a size and shape adapted securely to engage the openings of the selvage edge of said apertured overlay.

7. The perimeter securement assembly of claim 1 wherein said connector is of a size to extend a substantial length along said first element and is provided with a hooked portion in cross section to be substantially coextensive with said first element and the remainder of said connector being adapted to lie flat against said apertured overlay and be attached to the selvage edge of said apertured overlay by tack welding.

8. The perimeter securement assembly of claim 1 wherein said resilient means is made of an extruded rubber.

9. The perimeter securement assembly of claim 1 wherein said resilient means is made of an extruded hard rubber of a durometer reading of 40–70 Shore A.

* * * * *